US005417406A

United States Patent [19]

Fanchier, Jr.

[11] Patent Number: 5,417,406

[45] Date of Patent: May 23, 1995

[54] METHOD AND APPARATUS FOR LIFTING OBJECTS

[75] Inventor: Alton W. Fanchier, Jr., Olney, Tex.

[73] Assignee: Pulz-All, Inc., Wichita Falls, Tex.

[21] Appl. No.: 823,128

[22] Filed: Jan. 17, 1992

[51] Int. Cl.[6] ..... B66F 1/00; B66C 1/42

[52] U.S. Cl. ..... 254/199; 254/131; 254/227; 294/82.13

[58] Field of Search ..... 254/199, 121, 202, 209, 254/227, 231, 132, 139, 243, 323, 324, 30, 31, 226; 294/82.13

[56] References Cited

U.S. PATENT DOCUMENTS

| | | | |
|---|---|---|---|
| Re. 8,578 | 2/1879 | Carroll | 254/218 |
| 87,871 | 3/1869 | Oliver et al. | 254/218 |
| 218,725 | 8/1879 | Frederick | 254/199 |
| 224,746 | 2/1880 | Trump | 254/242 |
| 275,855 | 4/1883 | Reading | 254/227 X |
| 277,484 | 5/1883 | Hawes | 254/227 X |
| 287,002 | 10/1883 | Cornelieus | 254/227 X |
| 337,114 | 3/1886 | Barber | 254/226 |
| 737,765 | 9/1903 | Olsen | 254/217 |
| 806,010 | 11/1905 | Shaver | 254/339 |
| 932,444 | 8/1909 | Chambers | 254/227 X |
| 1,234,243 | 7/1917 | Williams | 254/259 |
| 1,577,439 | 3/1926 | Armbruster | 254/214 |
| 1,981,308 | 11/1934 | Copley | 254/227 X |
| 2,472,305 | 6/1949 | Miller | 254/30 |
| 2,865,601 | 12/1958 | Messick | 254/121 X |
| 5,054,744 | 10/1981 | Essex | 254/132 X |

FOREIGN PATENT DOCUMENTS

| | | | |
|---|---|---|---|
| 0055314 | 12/1920 | Norway | 294/82.13 |
| 0572437 | 2/1976 | Switzerland | 294/82.13 |
| 1523518 | 11/1989 | U.S.S.R. | 294/82.13 |

*Primary Examiner*—Clifford D. Crowder
*Assistant Examiner*—Ismael Izaguirre
*Attorney, Agent, or Firm*—H. Dennis Kelly; Timmons & Kelly

[57] ABSTRACT

The apparatus includes a frame having two vertical legs and a horizontal bridge beam. A chain hoist is mounted on an eye nut on the bridge beam. A primary chain and a secondary chain are suspended from the chain hoist. The secondary chain is connected to an object to be lifted. The secondary chain may be connected to C-shaped clamps, which are placed on the edge of the object to be lifted. After the object has been broken free of the ground, the frame may be tilted about a horizontal axis, to pull the object from the ground.

4 Claims, 2 Drawing Sheets

METHOD AND APPARATUS FOR LIFTING OBJECTS

BACKGROUND OF THE INVENTION

1. Field of the Invention

This invention relates in general to the art of lifting objects. In particular, the invention relates to apparatus and methods for pulling objects that are partially buried in the ground, such as fence posts or telephone poles. The apparatus can also be used to level objects by lifting one side of the object.

2. Description of the Prior Art

Machines have long been,used to help people pull stumps, fence posts, and other objects out of the ground. Some of these machines have involved a chain mounted on a frame, such as an A-frame or a tripod. The chain is connected to the object to be pulled, and then the chain is raised. The chain is usually raised by means of a pulley, a ratchet-wheel, or some similar article.

U.S. Pat. No. 1,577,439, issued to Armbruster on Mar. 23, 1926, discloses an apparatus for pulling posts partially buried in the ground. The Armbruster apparatus has two legs and a rotating shaft mounted between the upper ends of the legs. When the shaft is rotated, a toothed gear mounted on the shaft raises a chain. The chain can be attached to a secondary chain wrapped around the post to be pulled. The apparatus is operated by rotating the shaft to raise the chain and thus to lift the post.

SUMMARY OF THE INVENTION

The general object of the invention is to provide a method and apparatus for lifting objects. More specifically, an object of the invention is to provide a method and apparatus for pulling an object that is partially buried in the ground.

These objects are met by an apparatus having a frame comprising a pair of vertical legs and a horizontal bridge beam mounted between the legs. A chain hoist is hung from an eye nut on the bridge beam. A primary chain is suspended from the chain hoist and connected to a secondary chain wrapped around the object to be pulled.

The vertical legs of the frame have inner and outer legs, telescopically mated to allow the height of each leg to be adjusted. The height of the frame can thus be adjusted to the height of the object to be lifted. Also, the legs can be adjusted for use on uneven ground.

An alternate embodiment of the invention has clamps attached to each end of the secondary chain. The clamps can be attached to the object to be lifted. The clamps may be shaped to bind against the object as the chain is raised.

In the method of the invention, the frame is first placed next to the object to be lifted. The secondary chain, or the clamps on the ends of the secondary chain, are attached to the object, and the primary chain is attached to the secondary chain. The chain hoist is then actuated to raise the chain, and to break the object free of the ground. The frame can then be tilted, about a horizontal axis through the lower end of each leg, to pull the object upward from the ground.

The above, as well as additional objects, features, and advantages of the invention will become apparent in the following detailed description.

DESCRIPTION OF THE PREFERRED EMBODIMENT

Figure 1:
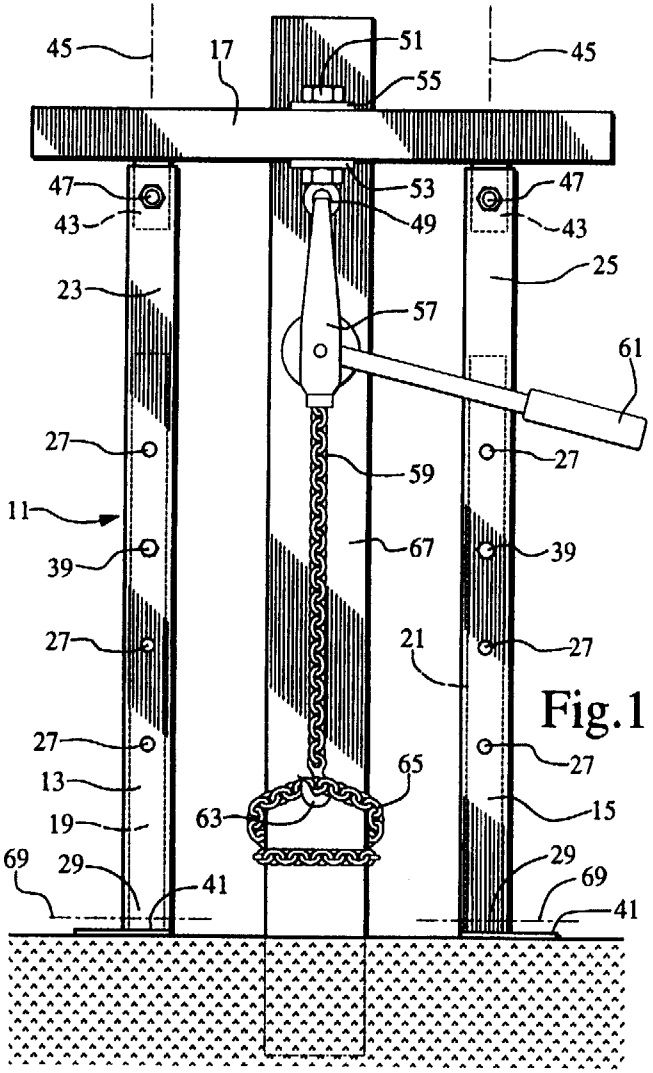
FIG. 1 is a front elevation of an apparatus according to the invention.
Figure 2:
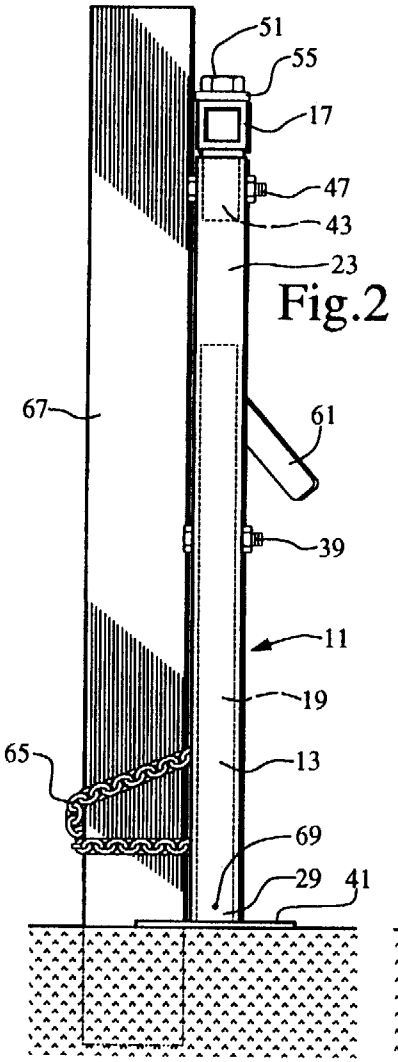
FIG. 2 is a left side elevation of an apparatus of the invention.
Figure 3:
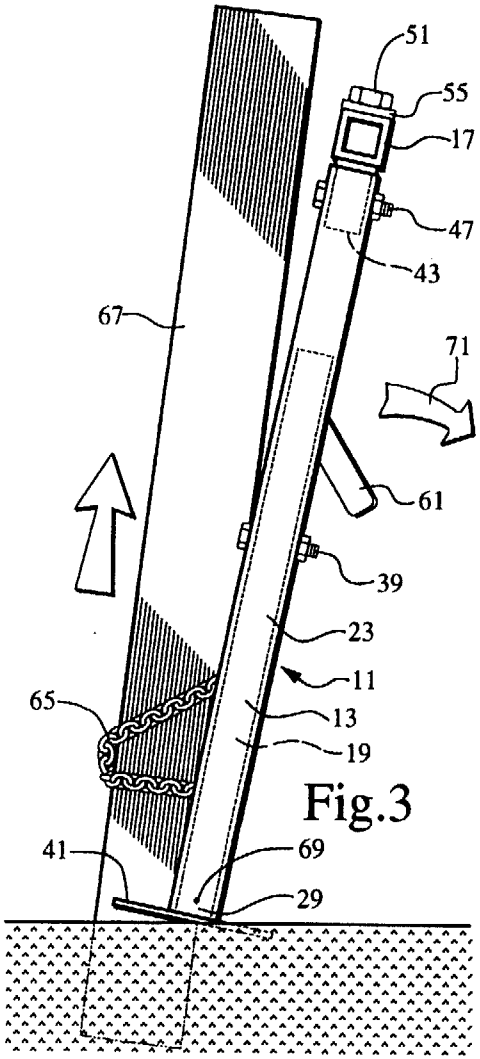
FIG. 3 is a left side elevation of an apparatus of the invention, wherein the frame is tilted forward.

FIGS. 1-3 illustrate a preferred embodiment of the apparatus of the invention. The apparatus of the invention includes a frame 11 comprising two vertical legs 13 and 15 and a horizontal bridge beam 17. Each leg 13 and 15 comprises an inner leg 19 and 21, telescopically received within an outer leg 23 and 25.

In the preferred embodiment, each outer leg 23 and 25 is about three feet, eight inches (one hundred and ten centimeters) long. The outer legs 23 and 25 are made of steel square tubing, having outside dimensions of two inches by two inches (five centimeters by five centimeters) and a thickness of one quarter inch (six millimeters).

Each outer leg 23 and 25 also has four adjustment holes 27, having one half inch (twelve millimeter) diameters. The adjustment holes 27 pass completely through the outer legs 23 and 25, and are four inches (ten centimeters) apart. The lowest adjustment hole 27 in each leg 23 and 25 is seven and five eighths inch (one hundred and ninety-four millimeters) up from the lower end 29 of the leg 23 and 25.

In the preferred embodiment, each inner leg 19 and 21 is about two feet (sixty-one centimeters) long. Each inner leg 19 and 21 is made of steel square tubing, having outside dimensions of one and one half inches by (thirty-eight by thirty-eight millimeters) and a thickness of one quarter inch (twelve millimeters).

Each inner leg 19 and 21 has four adjustment holes 27 having one half inch (twelve millimeters) diameters. The adjustment holes 27 pass completely through the inner legs 19 and 21, and are four inches (ten centimeters) apart. The lowest hole 27 in each leg 19 and 21 is seven and five eighths inch (one hundred and ninety-four millimeters) up from the lower end 37 of each leg 19 and 21.

The adjustment holes 27 in the inner legs 19 and 21 align with the adjustment holes 27 in the outer legs 23 and 25, and a one half inch (twelve millimeter) diameter leg adjustment pin 39 is inserted through the holes 27 to secure each inner leg 19 and 21 to an outer leg 23 and 25. A selected one of the adjustment holes 27 in the outer legs 23 and 25 can be aligned with a selected one of the adjustment holes 27 in the inner legs 19 and 21 to adjust the overall length of the legs 13 and 15. The lengths of the legs 13 and 15 can be adjusted at four inch (ten centimeter) intervals from a minimum of three feet eight inches (one hundred and twelve centimeters) to a maximum of four feet eight inches (one hundred and forty-two centimeters).

A base plate 41 is welded onto the lower end 37 of each inner leg 19 and 21. The base plates 41 are one quarter inch (six millimeter) thick Steel plates and are four inches (ten centimeters) wide by six inches (fifteen centimeters) long. The inner legs 19 and 21 are centered on the inner edges of the base plates 41, so the base plates 41 extend forward, backward, and outward to a distance of two inches (five centimeters) beyond the lower legs 19 and 21.

In the preferred embodiment, the bridge beam 17 is about two feet (sixty-one centimeters) long. The bridge beam 17 is made of steel square tubing having outside dimensions of two inches by two inches (five centimeters by five centimeters) and a thickness of one quarter inch (six millimeters).

A pair of leg inserts 43 are welded onto the bottom of the bridge beam 17. Each leg insert 43 is made of square tubing having outside dimensions of one and one half inches by one and one half inches (thirty eight millimeters by thirty-eight millimeters), a thickness of one quarter inch (six millimeters), and a length of about three inches (seventy-six millimeters). The centerline 45 of each leg insert 43 is located about five inches (one hundred twenty-seven millimeters) from one end of the bridge beam 17.

A connector pin 47 passes through aligned holes in the outer legs 23 and 25 and the leg inserts 43 to connect the bridge beam 17 to the legs 13 and 15. The connector pins 47 are located about one and one half inches (thirty-eight millimeters) down from the upper end of the outer legs 23 and 25.

An eye nut 49 is mounted on the lower side of the bridge beam 17 at the center of the beam 17. The eye nut 49 is mounted with a three quarter inch (nineteen millimeter) bolt 51, and with two plates 53 and 55 which are above and below the bridge beam 17. The two plates 53 and 55 are one quarter inch (six millimeter) thick, and measure two inches (five centimeters) square.

A chain hoist 57 is suspended from the eye nut 49. The preferred chain hoist 57 is a ratchet and pawl hoist 57, having a chain 59 and a handle 61 for operating the hoist 57. The hoist 57 is operated by moving the handle 61 up and down to raise or lower the chain 59.

A hook 63 is suspended from the lower end of the chain 59. The hook 63 is fastened to a secondary chain 65, which is wrapped around the post 67 or other object to be lifted.

FIGS. 1–3 illustrate the method of the invention, using the preferred embodiment of the apparatus of the invention. The first step is placing the frame 11 next to the object 67 to be lifted, such as the post 67 shown. The secondary chain 65 is wrapped around the post 67 several times to keep the secondary chain 65 from slipping. The hook 63 is then fastened to the secondary chain 65 to secure the chain 59 to the post 67.

After the chain 59 has been secured to the post 67, the handle 61 of the chain hoist 57 is moved up and down to actuate the chain hoist 57 and to raise the chain 59. The chain 59 is raised until the chain 59 is tight against the post 67. As the chain 59 is raised, the frame 11 will automatically align with the post 67, even if the post 67 is at a severe angle to the ground. The hoist 57 is then further actuated until the post 67 has broken free of the ground.

Finally, the frame 11 is tilted about a horizontal axis 69 through the base plates 41, as shown in FIG. 3. The hoist 57 moves through an arc 71 with a center at the axis 69 through the base plates 41. Since the hoist 57 is higher off of the ground than the secondary chain 65, the secondary chain 65 must move upward to remain a constant distance from the hoist 57. This causes the chain 59 to pull the post 67 upward from the ground.

Figure 5:
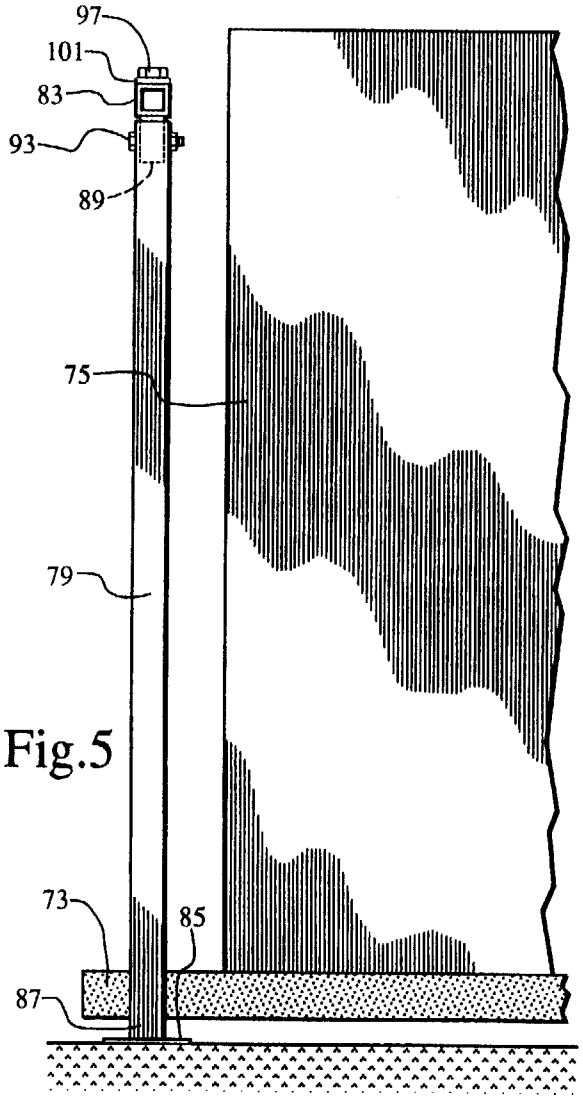
FIG. 5 is a right side elevation of the alternate embodiment shown in FIG. 4.
Figure 4:
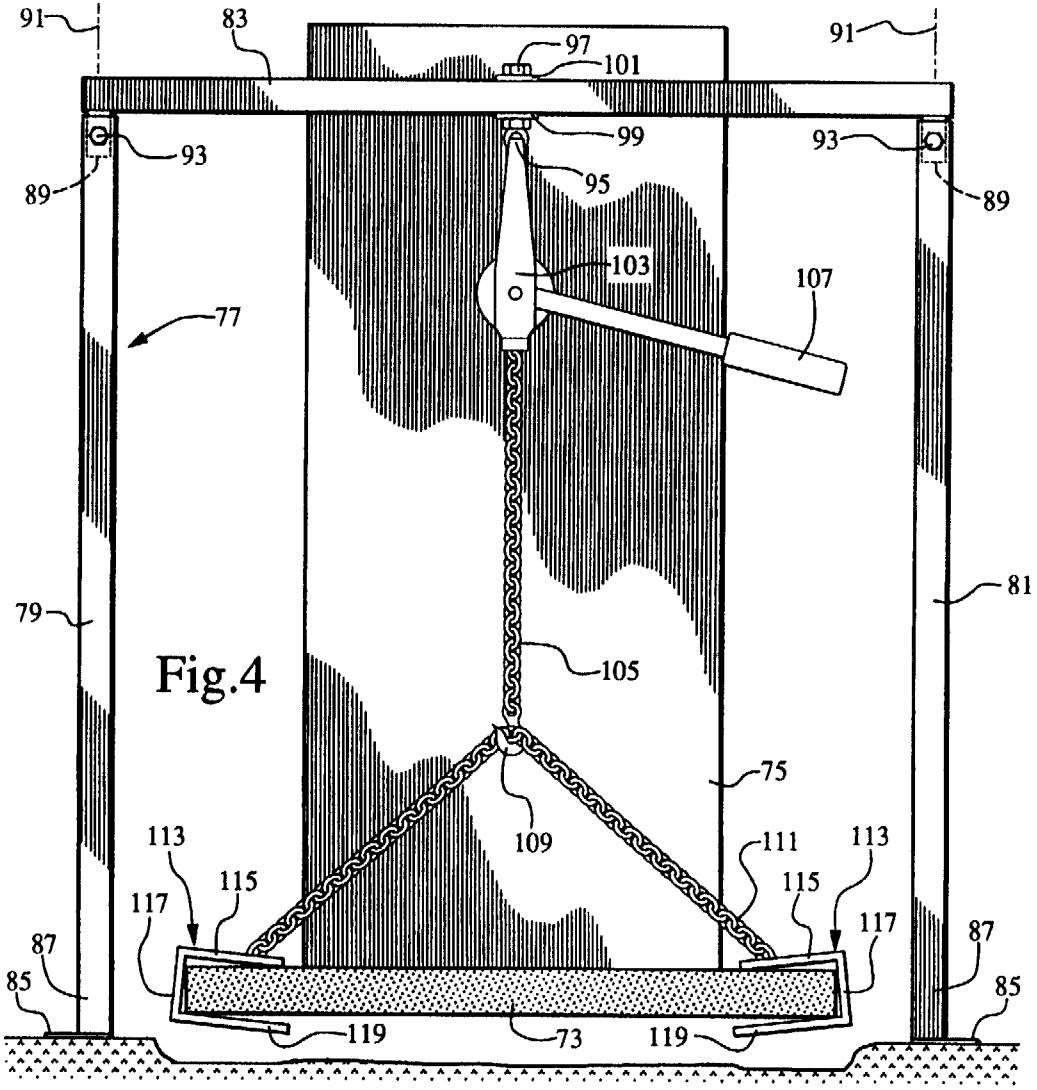
FIG. 4 is a front elevation of an alternate embodiment of the apparatus of the invention.

FIGS. 4 and 5 illustrate an alternate embodiment of the apparatus and method for lifting objects. This apparatus is especially useful in leveling platforms 73 of the type that support telephone or electrical equipment boxes 75.

The apparatus shown in FIGS. 4 and 5 has a frame 77 comprising two vertical legs 79 and 81, and a horizontal bridge beam 83. Each leg 79 and 81 is about four feet eight inches (one hundred and forty-two centimeters) long, and is made of steel square tubing having outside dimensions of two inches by two inches (five centimeters by five centimeters) and a thickness of one quarter inch (six millimeters). In this embodiment, the legs 79 and 81 are not adjustable. The bridge beam 83 is about four feet six inches (one hundred and thirty-seven centimeters) long and is also made of steel square tubing having outside dimensions of two inches by (five centimeters by five centimeters) two inches and a thickness of one quarter inch (six millimeters).

A base plate 85 is welded onto the lower end 87 of each leg 79 and 81. The base plates 85 are one quarter inch (si millimeter) thick steel plates and are four inches (ten centimeters) wide by six inches (fifteen centimeters) long. The legs 79 and 81 are centered on the inner edges of the base plates 85, so the base plates 85 extend forward, backward, and outward to a distance of two inches (five centimeters) beyond the legs 79 and 81.

A pair of leg inserts 89 are welded onto the bottom of the bridge beam 83. Each leg insert 89 is made of square tubing having outside dimensions of one and one half inches by one and one half inches (thirty-eight millimeters by thirty-eight millimeters), a thickness of one quarter inch (six millimeters) and a length of about three inches (seventy-six millimeters). The centerline 91 of each leg insert 89 is located about one inch (twenty-five millimeters) from one end of the bridge beam 83, so the legs 79 and 81 are connected to the ends of the bridge beam 83.

A connector pin 93 passes through aligned holes in the legs 79 and 81 and the leg inserts 89 to connect the bridge beam 83 to the legs 79 and 81. The connector pins 93 are located about one and one half inches (thirty-eight millimeters) down from the upper end of the legs 79 and 81.

An eye nut 95 is mounted on the lower side of the bridge beam 83 at the center of the beam 83. The eye nut 95 is mounted with a five eighths inch (sixteen millimeter) bolt 97, and with two plates 99 and 101 which are above and below the bridge beam 83. The two plates 99 and 101 are one quarter inch (six millimeters) thick, and measure two inches by two inches (five centimeters by five centimeters).

A chain hoist 103 is suspended from the eye nut 95. The preferred chain hoist 103 is a ratchet and pawl hoist 103, having a chain 105 and a handle 107 for operating the hoist 103. The hoist 103 is operated by moving the handle 107 up and down to raise or lower the chain 105.

A hook 109 is suspended from the lower end of the chain 105. The hook 109 is fastened to the middle of a secondary chain 111, which is about five feet (one hundred and fifty-two centimeters) long. A clamp 113 is connected to each end of the secondary chain 111.

Each clamp 113 has a top 115, a side 117, and a bottom 119. The top 115, side 117, and bottom 119 are connected end to end, to form a generally C-shaped clamp 113. The secondary chain 11 is connected to the free end of the top 115 of the clamp 113.

Each clamp 113 is made of one half (twelve millimeter) inch thick steel plate, and is four inches (ten centimeters) wide. The top 115 is four inches (ten centimeters) long, and the bottom 119 is six inches (fifteen centimeters) long. The side 117 is long enough to leave a clearance between the top 115 and bottom 119 of at least six and one quarter inches (sixteen centimeters).

The clearance between the top 115 and bottom 119 of the clamp 113 allows the clamp 113 to be easily placed on a standard platform 73, which is commonly about six inches (fifteen centimeters) thick. When the chain hoist 103 is actuated, and the secondary chain 111 is raised, the clamps 113 bind on the platform 73 to securely grip the platform 73.

The method of using the apparatus shown in FIGS. 4 and 5 begins with placing the frame 77 next to the equipment box 75 and over the edge of the platform 73. The clamps 113 are then placed on the edges of the platform 73. The chain hoist 103 is then actuated to raise the chain 105 and the secondary chain 111. As the secondary chain 111 lifts the clamps 113, the clamps 113 bind on the edges of the platform 73 to securely grip the platform 73. The chain hoist 103 can be actuated until the edge of the platform 73 has been raised to the desired level. Material, such as soil or gravel, can then be placed under the platform 73 to hold the position of the platform 73.

The method and apparatus of the invention have several advantages over the prior art. The invention provides an easy and efficient apparatus and method for pulling posts or for leveling platforms. Also, if the post is embedded in the ground at an angle to the surface, the frame of the apparatus will automatically align itself with the post as the chain is raised.

The invention has been shown in only two embodiments. It should be apparent to those skilled in the art that the invention is not so limited, but is susceptible to various changes and modifications without departing from the spirit of the invention.

I claim:

1. A device for lifting an object, comprising:

a pair of vertical legs;

a horizontal bridge beam, mounted on the legs;

a chain hoist mounted on the bridge beam, having a primary chain suspended from the chain hoist, wherein the vertical legs, the bridge beam and the chain hoist all lie in a single plane;

a secondary chain having ends and a middle, wherein the primary chain is connected to the middle of the secondary chain; and a pair of clamps connected to the ends of the secondary chain for gripping the object to be lifted, the clamps having tops with free ends, sides, and bottoms, and being adapted to fit on the object to be lifted, the ends of the secondary chain being connected to the free ends of the tops of the clamps, causing the clamps to bind on the object to be lifted.

2. A method for lifting an object, comprising the steps of:

placing a frame next to the object, the frame having a pair of vertical legs and a horizontal bridge beam mounted between the legs, the vertical legs and the horizontal bridge beam lying in a single plane;

attaching a secondary chain to the object by placing clamps on the object, the clamps being connected to the ends of the secondary chain;

attaching a primary chain to the secondary chain, the primary chain being a part of a chain hoist mounted on the bridge beam; and actuating the chain hoist to raise the primary chain until the object has been lifted a selected distance.

3. A method as recited in claim 2, wherein C-shaped clamps are placed on the object to be lifted.

4. A device for lifting an object, comprising a pair of vertical legs;

a horizontal bridge beam, mounted on the legs;

a chain hoist mounted on the bridge beam, having a primary chain suspended from the chain hoist, wherein the vertical legs, the bridge beam and the chain hoist all lie in a single plane;

a secondary chain having ends and a middle, wherein the primary chain is connected to the middle of the secondary chain; and a pair of clamps connected to the ends of the secondary chain, the clamps having tops with free ends, sides, and bottoms, and being adapted to fit on the object to be lifted, the ends of the secondary chain being connected to the free ends of the tops of the clamps, causing the clamps to bind on the object to be lifted.

* * * * *